US006385514B1

(12) United States Patent
Tarr

(10) Patent No.: US 6,385,514 B1
(45) Date of Patent: May 7, 2002

(54) SHIPBOARD SYSTEM FOR FURNISHING INFORMATION ON MINE THREAT VULNERABILITY

(75) Inventor: Paulo B. Tarr, Silver Spring, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/845,228

(22) Filed: May 1, 2001

(51) Int. Cl.[7] ..... G05D 1/00

(52) U.S. Cl. ..... 701/21; 701/25

(58) Field of Search ..... 701/21, 25, 23, 701/24, 200, 301; 318/588

(56) References Cited

U.S. PATENT DOCUMENTS

| | | | | |
|---|---|---|---|---|
| 4,340,936 A | | 7/1982 | Mounce | |
| 5,523,951 A | | 6/1996 | Kriesgman et al. | |
| 5,790,405 A | * | 8/1998 | Buchler | 701/21 |
| 6,006,145 A | | 12/1999 | Bessacini | |
| 6,035,254 A | | 3/2000 | Nichols | |

* cited by examiner

*Primary Examiner*—Richard M. Camby
(74) *Attorney, Agent, or Firm*—Jacob Shuster

(57) ABSTRACT

Data on influencing signatures of world-wide sea mine models is collected on board a host sea vessel and undergoes periodic updating to maintain accuracy of the display on vessel vulnerability to such sea mines, obtained on-board from such collected data, measurements of current status conditions of the host vessel and calculation therefrom of surface actuation onsets with respect to each of the sea mine models.

9 Claims, 1 Drawing Sheet

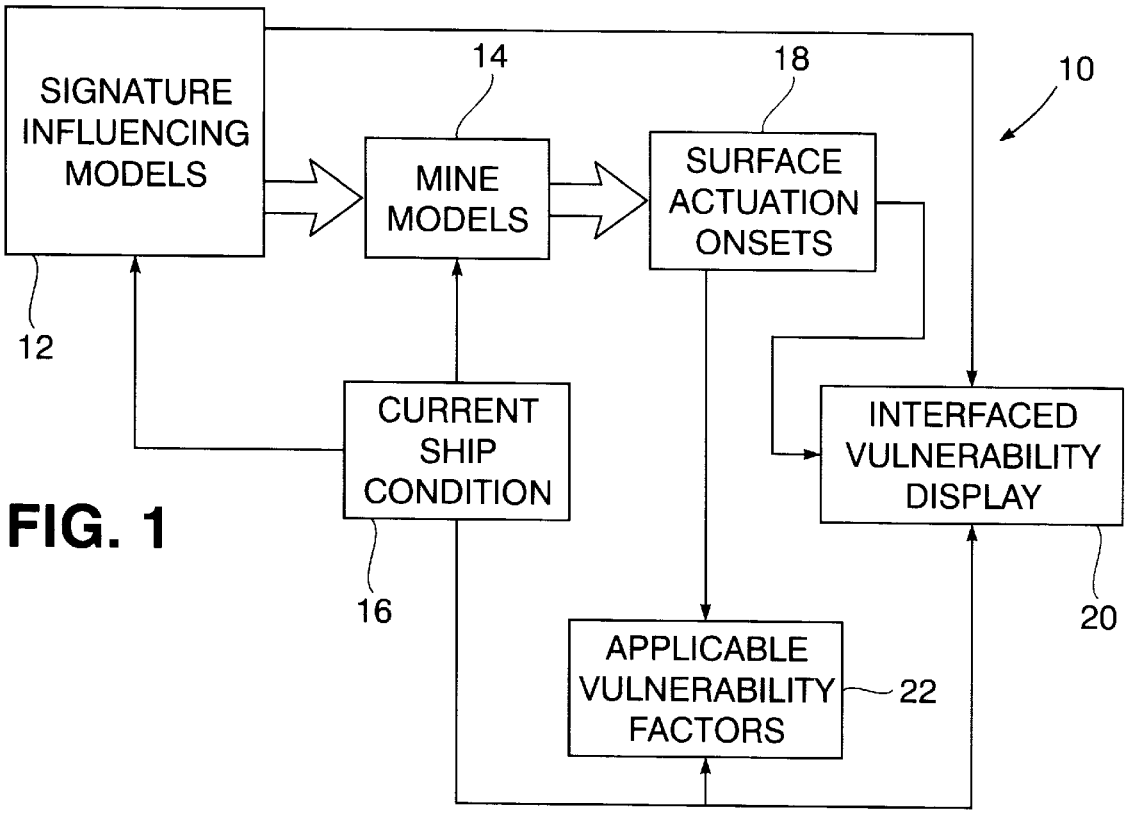
FIG. 1
FIG. 2
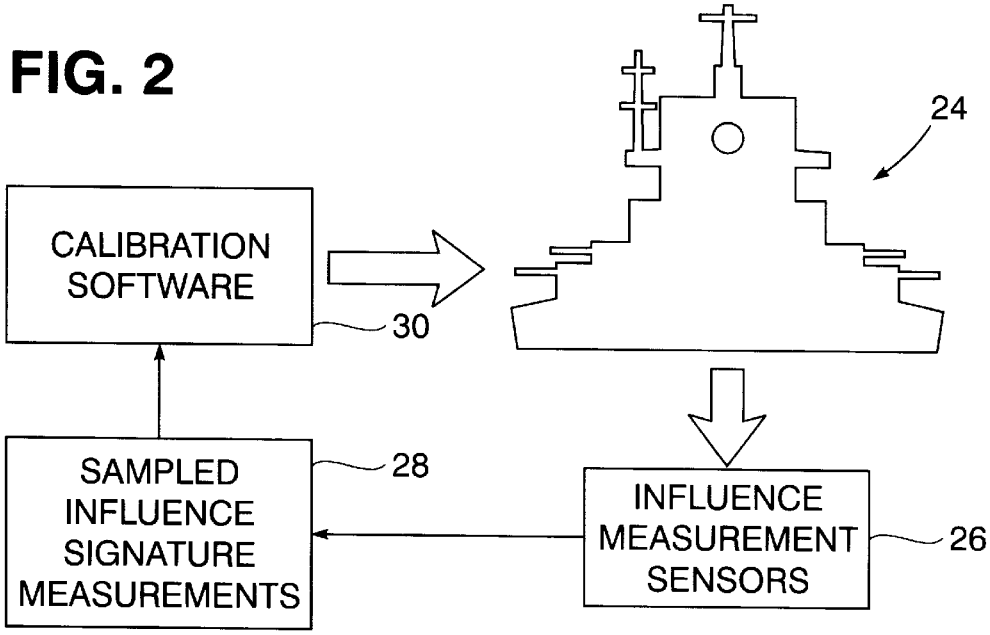

SHIPBOARD SYSTEM FOR FURNISHING INFORMATION ON MINE THREAT VULNERABILITY

The present invention relates generally to determination and display of vulnerability of marine vessels to mine threats.

BACKGROUND OF THE INVENTION

Currently, the vulnerability of Naval combatant sea vessels to sea mines is computed off-line, utilizing a disparate collection of data derived from different mine models, techniques and locations. Vulnerability estimates so obtained range from rule-of-thumb calculations to computer simulated ship-mine interactions. Influence data models currently utilized often are of a general or "class" nature and do not reflect the states or conditions of individual ships. Thus, the mine vulnerability information heretofore generated was of a widely varying quality and accuracy not readily available to Naval combatant commanding officers or fleet tacticians and strategists. It is therefore an important object of the present invention to more readily provide detailed and accurate information on board a marine vessel about its vulnerability to a wide variety of mine threats.

SUMMARY OF THE INVENTION

In accordance with the present invention, sea mine vulnerability data is calibrated and displayed on board a host ship by use of magnetic, electric, acoustic and other influencing signatures that are periodically updated by recalibration of their influence model parameters from sampled sensor measurements performed at a magnetic silencing facility. Such influencing signature models are utilized and interrelated with models of different world-wide sea mines and the current states and conditions of the host ship to provide calibrations which correspond to actuation surface onsets on the different mine models for a most accurate and readily available on-board display of sea mine vulnerability information.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 1 is schematic diagram of a system for providing mine vulnerability information system in accordance with one embodiment of the present invention; and FIG. 2 is a diagram of a system for periodic calibration of parameters for the influence signatures of mine models for use in the system depicted in FIG. 1.

DESCRIPTION OF PREFERRED EMBODIMENTS

Referring now to the drawing in detail, FIG. 1 schematically depicts a system 10 of the present invention establishing a method for providing on board a host ship information regarding its vulnerability to sea mines. Such method of the system 10 is predicated on use of different influencing signature models reflected by a data collection 12, including magnetic, electric and acoustic signatures. Data from such collection 12 of signature influencing models is applied to models of different world-wide sea mines in existence as reflected in a data collection 14. The data collections 12 and 14 are interrelated in accordance with a vector derived from a data collection 16 on the current condition of the host ship for calculation purposes. The condition of the host ship reflected by the data collection 16 is dependent on factors such as its geographic location, speed, heading and water depth. Calculations are performed from inputs received from the data collection sources 12 and 14 to provide a data collection 18 corresponding to onsets of surface actuation for each mine model. Such data from collection 18 is transferred in parallel with data from the model collection 12 to a mine vulnerability display 20 interfaced on the host ship. The display 20 is interfaced by data on the current condition state of the host ship from data collection 16 and from the surface actuation onset data from collection 18 interrelated therewith in accordance with a data collection 22 on applicable mine vulnerability factors for each mine model, such as actuation width and safe operating area. The resulting mine vulnerability information provided by the interfaced display 20 is in textual, two-dimensional and three-dimensional formats.

In order to maintain accuracy, it is required pursuant to the present invention that the host ship 24, as diagrammed in FIG. 2, be periodically ranged at a magnetic silencing facility calibrate the parameters of the influence signatures for the sea mine models in the data collection 12 diagrammed in FIG. 1. The calibration process involved, as diagrammed in FIG. 2, includes passage of the host ship 24 over sensors 26 through which a range of influence signature measurements are obtained and undergo uniformly timed sampling 28. Such sampled measurements are then applied to software 30 for calibration of new influence model parameters from which the data for the signature influencing model collection 12 of system 10 is derived.

It will be apparent from the foregoing description that the mine vulnerability information provided by the display 20 will be maintained accurate by reflecting the current states and conditions of the host ship 24 with which it is associated, on a real time basis so as to make such information readily available on-board such host ship.

Obviously, other modifications and variations of the present invention may be possible in light of the foregoing teachings. It is therefore to be understood that within the scope of the appended claims the invention may be practiced otherwise than as specifically described.

What is claimed is:

1. A method for determination of vulnerability of marine vessels to worldwide sea mines from data on models thereof based on influencing signatures and surface actuation onsets respectively associated with said sea mine models, comprising the steps of: collecting data on the influencing signatures on-board of a host sea vessel; performing on-board measurement of status conditions of the host sea vessel; performing real time calculation of the data corresponding to the surface actuation onsets from the collected data on the influencing signatures of the sea mine models; and displaying on-board the host vessel the vulnerability to the sea mines from the collected data on the signatures, the on-board measurement of status conditions thereof and the calculation of the surface actuation onsets.

2. The method as defined in claim 1, wherein the calculation of the surface actuation onsets for the sea mine models is interrelated with the measurement of status conditions of the host vessel in accordance with a plurality of applicability factors, including actuation surface width and safe operating surface area for each of the sea mine models.

3. The method as defined in claim 2, wherein the influencing signatures respectively associated with the sea mine models include magnetic, electric and acoustic signatures.

4. The method as defined in claim 3, wherein the status conditions of the host vessel undergoing measurement include geomagnetic location, speed, heading and water depth.

5. The method as defined in claim 1, wherein the influencing signatures respectively associated with the sea mine models include magnetic, electric and acoustic signatures.

6. The method as defined in claim 1, wherein the status conditions of the host vessel undergoing measurement include geomagnetic location, speed, heading and water depth.

7. The method as defined in claim 1, including: periodic updating of the collected data on the influencing signatures to maintain accuracy of the sea mine vulnerability being displayed onboard.

8. The method as defined in claim 7, wherein said periodic updating of the collected data comprises the steps of: passing the host vessel over sensors at a magnetic silencing facility to obtain measurements of the influencing signatures; sampling said measurements; and calibrating new influence signature parameters from the sampled measurements.

9. The method as defined in claim 8, wherein the calculation of the surface actuation onsets for the sea mine models is interrelated with the measurement of status conditions of the host vessel in accordance with a plurality of applicability factors.

* * * * *